US011498712B2

(12) United States Patent
Voss et al.

(10) Patent No.: US 11,498,712 B2
(45) Date of Patent: Nov. 15, 2022

(54) FILLING DEVICE AND METHOD FOR FILLING UPWARDLY OPEN PACKAGING CONTAINERS, AND FORM-FILL-SEAL DEVICE

(71) Applicant: Windmöller & Hölscher KG, Lengerich (DE)

(72) Inventors: Hans-Ludwig Voss, Lengerich (DE); Oliver Huil, Lengerich (DE); Christian Häger, Lengerich (DE); Ralf Udally, Lengerich (DE)

(73) Assignee: Windmöller & Hölscher KG, Lengerich (DE)

( * ) Notice: Subject to any disclaimer, the term of this patent is extended or adjusted under 35 U.S.C. 154(b) by 0 days.

(21) Appl. No.: 16/960,694

(22) PCT Filed: Jan. 7, 2019

(86) PCT No.: PCT/EP2019/050248
§ 371 (c)(1),
(2) Date: Jul. 8, 2020

(87) PCT Pub. No.: WO2019/137873
PCT Pub. Date: Jul. 18, 2019

(65) Prior Publication Data

US 2020/0354098 A1 Nov. 12, 2020

(30) Foreign Application Priority Data

Jan. 11, 2018 (DE) ..... 102018200432.3

(51) Int. Cl.
*B65B 43/30* (2006.01)
*B65B 1/02* (2006.01)
(Continued)

(52) U.S. Cl.
CPC ..... *B65B 43/30* (2013.01); *B65B 1/02* (2013.01); *B65B 1/32* (2013.01); *B65B 39/002* (2013.01);
(Continued)

(58) Field of Classification Search
CPC ..... B65B 43/04; B65B 43/54; B65B 43/30; B65B 1/02; B65B 1/32; B65B 57/14;
(Continued)

(56) References Cited

U.S. PATENT DOCUMENTS 4,412,556 A * 11/1983 Janich ..... F16K 1/221 137/614.11
4,844,292 A * 7/1989 Lonardi ..... B65D 90/582 222/503
(Continued)

FOREIGN PATENT DOCUMENTS

DE 3809546 A1 10/1988
DE 102010045178 A1 3/2012
(Continued)

*Primary Examiner* — Thomas M Wittenschlaeger
(74) *Attorney, Agent, or Firm* — Peter W. Schroen; Bret E. Field; Bozicevic, Field & Francis LLP

(57) ABSTRACT

The invention describes a filling device with a discharge container for filling upwardly open packaging containers with at least one opening flap for opening and closing a discharge opening for the product, the opening flap being moveable along a path between a closed position and an open position by means of a driving element.
At least one delay device is provided by means of which the movement of the opening flap may be delayed on a section of the path.

7 Claims, 5 Drawing Sheets

Figure 1:
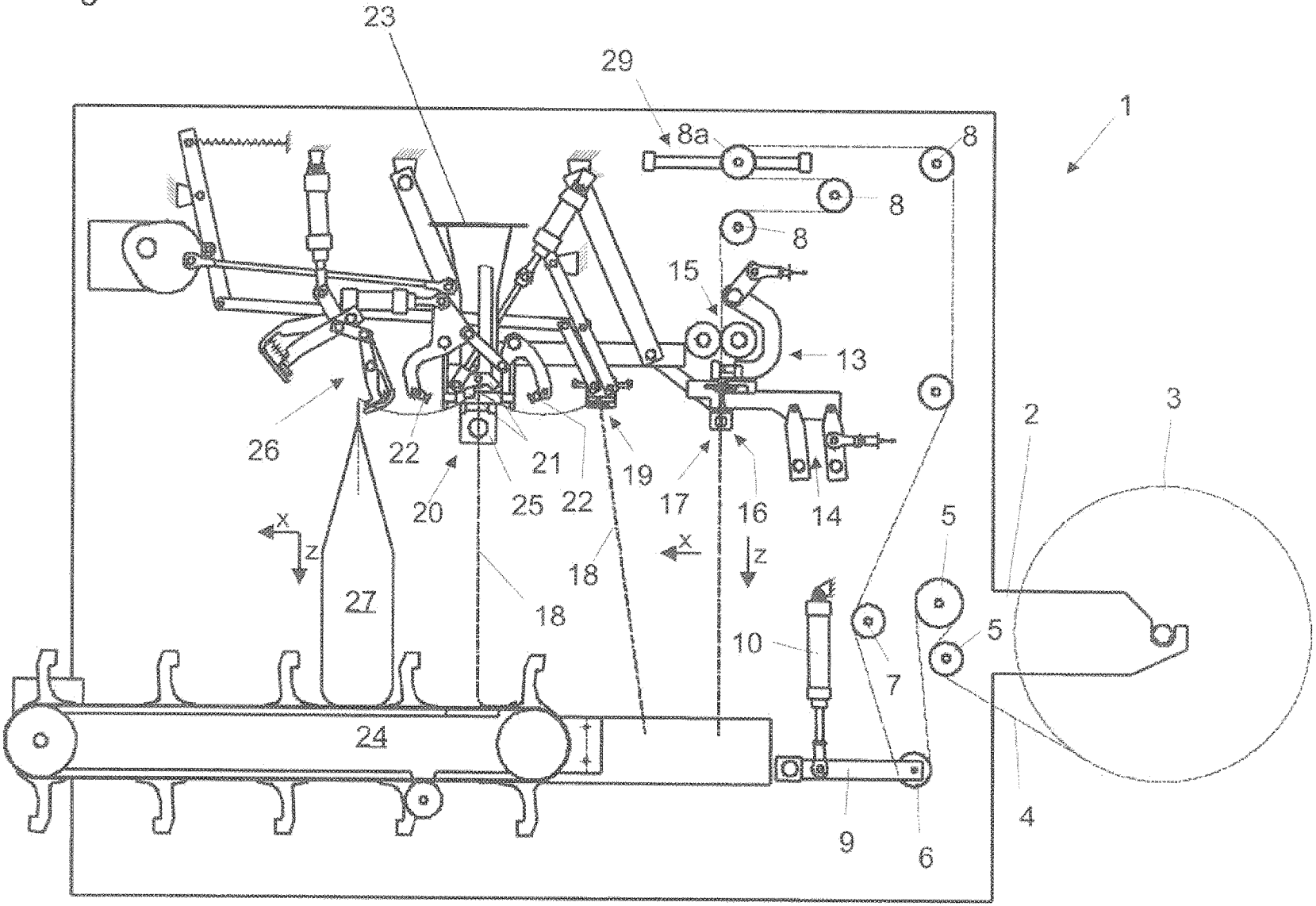

(51) Int. Cl.

| | |
|---|---|
| ***B65B 1/32*** | (2006.01) |
| ***B65B 39/00*** | (2006.01) |
| ***B65B 43/04*** | (2006.01) |
| ***B65B 43/54*** | (2006.01) |
| ***B65B 57/14*** | (2006.01) |

(52) U.S. Cl.
CPC ..... *B65B 43/04* (2013.01); *B65B 43/54* (2013.01); *B65B 57/14* (2013.01)

(58) Field of Classification Search
CPC ..... B65B 39/002; F16K 1/20; F16K 31/122; F16F 9/43; F16F 9/02
See application file for complete search history.

(56) References Cited

U.S. PATENT DOCUMENTS 5,267,356 A * 12/1993 Gideon ..... A47K 13/10 16/69
5,409,149 A * 4/1995 Hough ..... B01F 15/00785 105/286
5,579,874 A * 12/1996 Jeffries ..... E05F 1/16 188/282.9
6,173,938 B1 * 1/2001 McAndrew ..... F15B 15/223 251/31
6,676,407 B2 * 1/2004 Largent ..... F23G 5/444 432/103
6,745,701 B2 * 6/2004 Elder ..... B65D 90/623 105/247
7,137,729 B2 * 11/2006 Moretto ..... B29B 7/283 366/141
7,770,362 B2 * 8/2010 Koehn ..... B65B 1/02 493/196
8,071,014 B2 * 12/2011 Irnich ..... F27B 1/20 266/199
8,091,858 B2 * 1/2012 Janich ..... F16K 11/052 251/58
8,413,954 B1 * 4/2013 Burrow ..... F16K 3/22 251/147
9,920,561 B2 * 3/2018 Fan ..... E05F 3/02
2016/0122042 A1 * 5/2016 Breulmann ..... B65B 39/007 53/473
2020/0355203 A1 * 11/2020 Takada ..... F15B 11/06

FOREIGN PATENT DOCUMENTS

DE 102013010048 A1 12/2014
DE 102013105754 A1 12/2014
WO WO-9734131 A1 * 9/1997 ..... G01G 19/393

* cited by examiner

FILLING DEVICE AND METHOD FOR FILLING UPWARDLY OPEN PACKAGING CONTAINERS, AND FORM-FILL-SEAL DEVICE

The invention relates to a filling device with a discharge container for filling upwardly open packaging containers, a method and a form-fill-seal device.

Such filling devices are already known for a long time and are used many times on a daily base in order to fill fix or flexible packaging containers. They are used particularly in filling machines by means of which bags are filled which are preferably open at the top, but closed at the bottom end. In the field of heavy duty bags, i. e., bags which are filled with a filling weight of at least 5 kg, the bags are normally closed at the bottom before they reach the filling device. For this purpose, in a bag producing device, a tube piece of a tube is separated and closed at the bottom, the latter being preferably performed before the separation. Preferably, the bag producing device and the filling device are parts of a single machine which is often referred to as a FFS machine. Within the same, a bag is transported by the bag producing device by means of transport members, normally grippers, to the filling device.

In the discharge container of the filling device, the product (also referred to as "filling material" in the following), which is a pourable or free-flowing product, rests at least in part on at least one opening flap when the latter is in its closed position. When the opening flap is opening and when the opening flap is in its open position, in which the discharge opening has its largest opening surface, the product falls into the bag disposed below the discharge container due to gravity. With increasing filling rates, the fact that a part of the product first adheres to the opening flap when the opening flap is opening before it slips when the opening flap is further opening, is playing an increasing role. In an extreme case, the closing operation of the opening flap already begins again without the product having been dispensed completely into the bag. In order to avoid this disadvantage, efforts have been made to increase the rate of the opening movement in order to reduce the filling time this way. However, the opening flap then strikes with a higher speed the open position, thereby increasing the mechanical stress of the filling device. Thereby, even the product scale can be affected adversely by means of which the product amount, which is filled into a single bag, is weighted.

Therefore, the aim of the present invention is to avoid the disadvantages which have been described previously. Particularly, the aim is to reduce the filling time and thereby keep identical or even reduce the mechanical stresses of the filling device.

This aim is achieved by means of the features of the present disclosure. Accordingly, in case of a previously described filling device, a delay device is provided by means of which the movement of the opening flap on a section of the path can be delayed.

First of all, the movement of the at least one opening flap is induced by a driving element, the driving element applying a force to the opening flap. Preferably, this driving element is arranged for the movement for opening, but also for closing the discharge opening. It may be an electrical driving element, but also a pneumatic driving element. In the latter case, preferably, a double-acting piston-cylinder unit, i. e., a piston-cylinder unit which acts in both directions, is provided. A pneumatic driving element is advantageous, as it is cost-effective and has a low weight. However, other driving types are also conceivable at this point and may be provided depending on the requirements.

Of course, the expression "at least one opening flap" also encompasses multiple opening flaps. Preferably, two opening flaps are provided such that the discharge opening may be opened and closed quickly. The type of movement of the opening flap may be a pivoting, turning, displacing and/or another type of movement.

Preferably, the movement of the opening flap is limited by end stops once the closed position is reached and/or once the open position is reached.

By the provision of a delay device it is possible to apply an additional delay force to the movement of the opening flap and thereby slow it down. Accordingly, this delay force does not result from the ever-present friction of the involved components, but has to be considered as an additional force. According to the invention, this additional force is provided on a part of the movement of the opening flap. Thus, on at least a second part, the movement of the opening flap occurs without any influence by the delay device. It is thereby possible to operate the opening flap on this second part with a higher opening speed compared to the state of the art such that the discharge opening can be completely or almost completely opened with a higher speed than before. In part, this measure reduces considerably the filling time. With the delay device according to the invention, the higher speed of the opening flap can be slowed down now such that the opening flap passes to the closed and/or open position with a clearly reduced speed, whereby the mechanical stress may be reduced.

Thereby, it is preferable when the part, on which the opening flap may be delayed, is shorter than the path between the closed position and the open position, otherwise the desired result, namely the obtaining of a high speed on a second part, cannot be achieved sufficiently. Preferably, said part is smaller than 50%, preferably smaller than 30%, of the path between the closed position and the open position. Thereby, said part extends preferably until the open position in case of an opening of the opening flap or until the closed position in case of a closing of the opening flap.

In a further configuration, a switching element is provided by means of which the delay element can be connected. Thus, the beginning of the delay, preferably also the end of the delay, can be switched with this switching element. Advantageously, this switching element is controlled by a control device. The advantage of a switching element is that the beginning of the delay is variable and thus can be adapted to the moving speed of the opening flap.

Thereby, it is advantageous if a valve (also referred to as switching valve) is provided as the switching element. A fluid stream can be passed through or interrupted with such a valve. Thus, a fluid stream, particularly an air stream, which is induced by the moving opening flap, may be provided in the passing position of the valve without any resistance. However, if the valve is closed, then the stream is interrupted and the opening flap experiences a delaying resistance. For this purpose, a compressible fluid may be provided. In this respect, preferably, a valve is a fast-switching valve with switching times of less than 20 microseconds (ms), particularly less than 10 ms. It is advantageous when the fast-switching valve is embodied as a magnetic valve, for example.

However, a switching element which may be provided according to the present invention, for example, may also connect and disconnect an electrical brake. However, a mechanical delay element, such as a spring element, which may be operatively connected with the opening flap or operatively disconnected from it by means of a switching element, may also be provided.

In a further configuration of the invention it is provided that the delay device comprises a throttle element, particularly an air throttle. For example, with a throttle element, the kinetic energy which is transferred from the opening flap to the fluid, may be converted into another energy form, for example, thermal energy. Colloquially, the term "energy dissipation" is often used. The advantage of a throttle element is that the relay of the opening flap extends over a significant time period such that the movement of the opening flap is not finished too quickly. A too sudden finishing of the movement may imply high stresses of the involved components which may be reduced with a throttle element. Moreover, it may be provided that the throttle performance of the throttle element is variable, particularly adjustable. Thus, the amount of the delay may be adapted to the current requirements. A preferred example of a throttle element is an air throttle by means of which in particular the amount of air which may be passed through may be reduced.

In a preferred configuration of the invention it is provided that the filling device comprises a product scale at which the opening flaps are arranged. Thereby, particularly the part of the product which may already be in the discharge container, may be weighted. In this case, the present invention may be employed in a very advantageous manner because—as already described—the opening flap passes to the open position and/or the closed position with a very reduced speed compared to the state of the art such that mechanical stresses and the related vibrations are reduced. Basically, vibrations affect adversely the weighing such that the present invention may improve the quality of the weighing.

Moreover, the aim mentioned above is also achieved by means of a method according to the present disclosure. The method for filling upwardly open packaging containers by means of a filling device with a discharge container and with at least one opening flap for opening and closing a discharge opening for the product, the opening flap being moved along a path between a closed position and an open position by means of a driving element, is characterized according to the invention in that the movement of the opening flap is delayed by means of at least one delay device on a section of the path.

Thereby, the same advantages are achieved with the method according to the invention which have already been described above in relation to the filling device according to the invention.

Said aim is further achieved by means of a form-fill-seal device which comprises a bag forming device by means of which tube pieces may be separated subsequently from a tube material, the bottom ends of which may be provided in each case with a base so as to form upwardly open bags, a filling device for successively filling a product into the bags, a closing device by means of which the upper openings of the bags may be closed, retaining devices by means of which the bags may be retained within at least one of the above-mentioned devices, transport devices by means of which the bags may be carried individually between the individual devices mentioned above, and is characterized according to the invention in that it comprises the filling device as described above.

The same advantages as already described in relation to a filling device according to the invention may be achieved with such a form-fill-seal device. In case of the form-fill-seal device according to the invention, the bags are produced, filled and closed in respective separate devices, which are often also referred to as stations, whereby they are never unguided because of the transport and retaining devices within the form-fill-seal device.

Further advantages, features and details of the invention become evident from the following description in which various example embodiments are discussed in detail with reference to the figures. Thereby, the features mentioned in the claims and in the description individually for themselves or any combination of mentioned features may be essential for the invention. Of course, throughout the disclosure, the claims and details which are described in relation with the method according to the invention, also apply in relation to the filling device according to the invention and/or to the form-fill-seal device according to the invention and vice versa such that reference is always made or may always be made reciprocally with respect to the disclosure concerning the individual aspects of the invention. The individual figures show:

FIG. 1 a form-fill-seal machine

Figure 2:
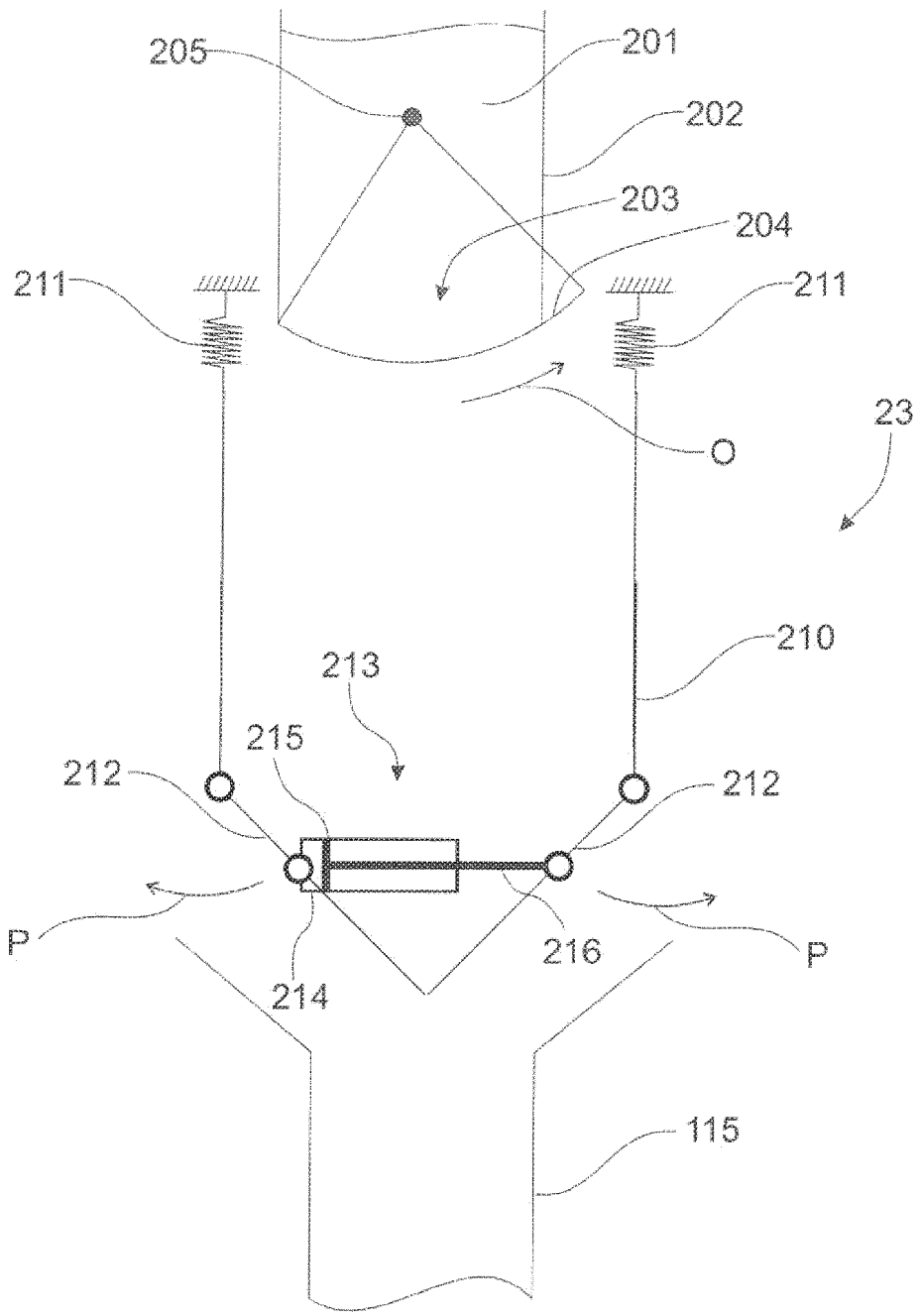

FIG. 2 details of a filling device according to the invention

Figure 3:
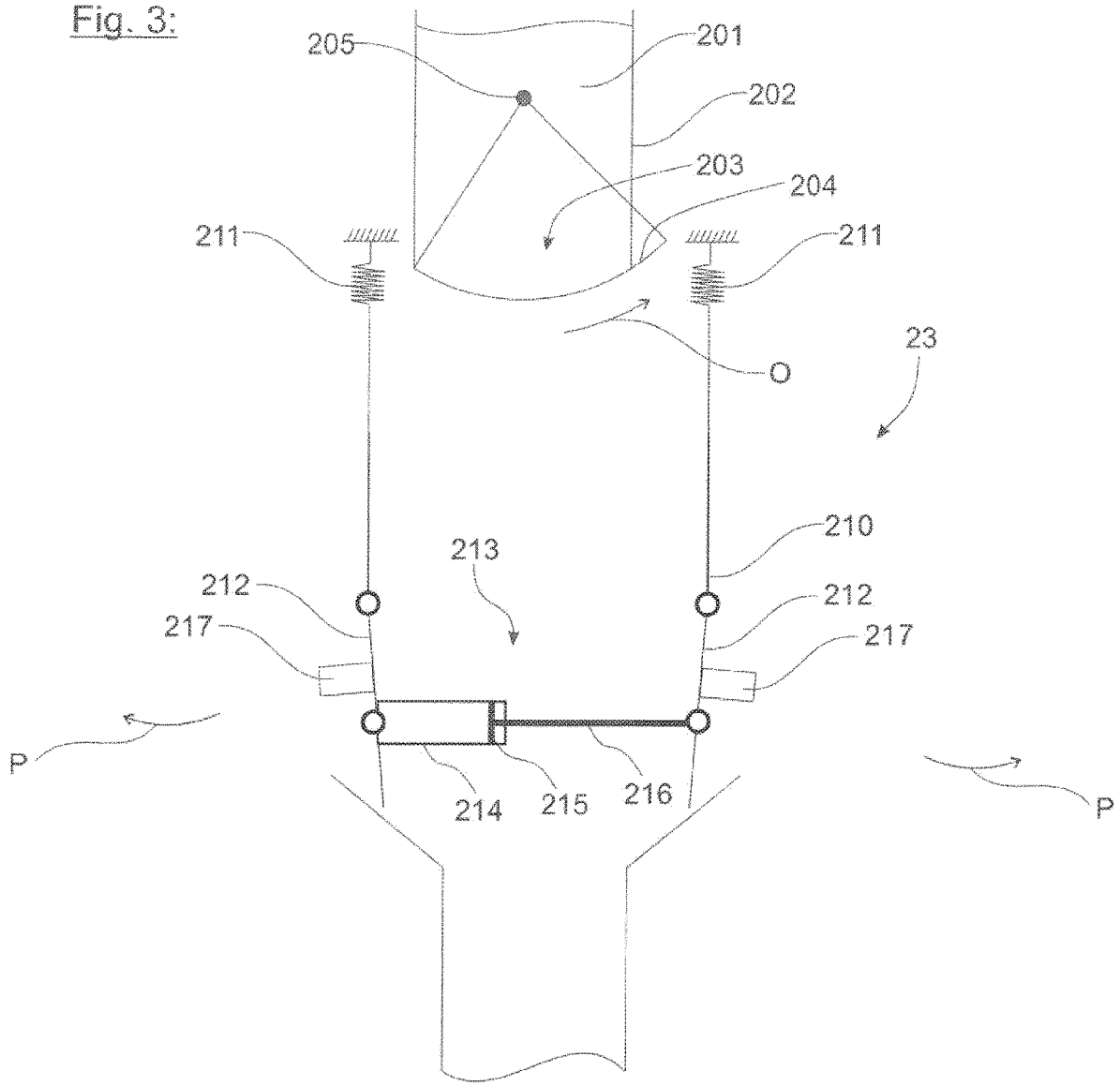

FIG. 3 like FIG. 1, but with open opening flaps

Figure 4:
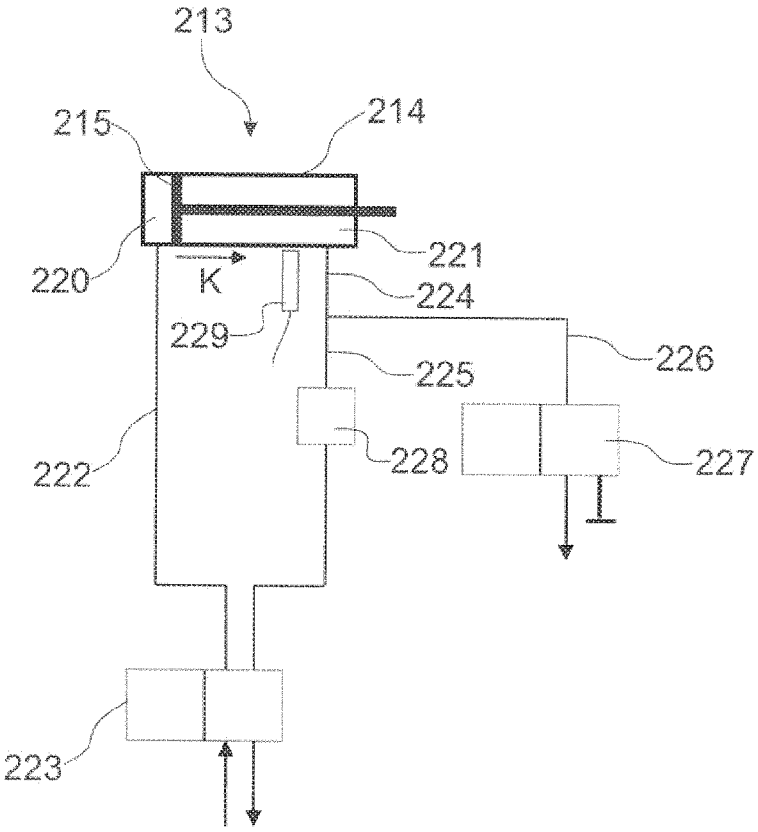

FIG. 4 a first structure of a filling device according to the invention

Figure 5:
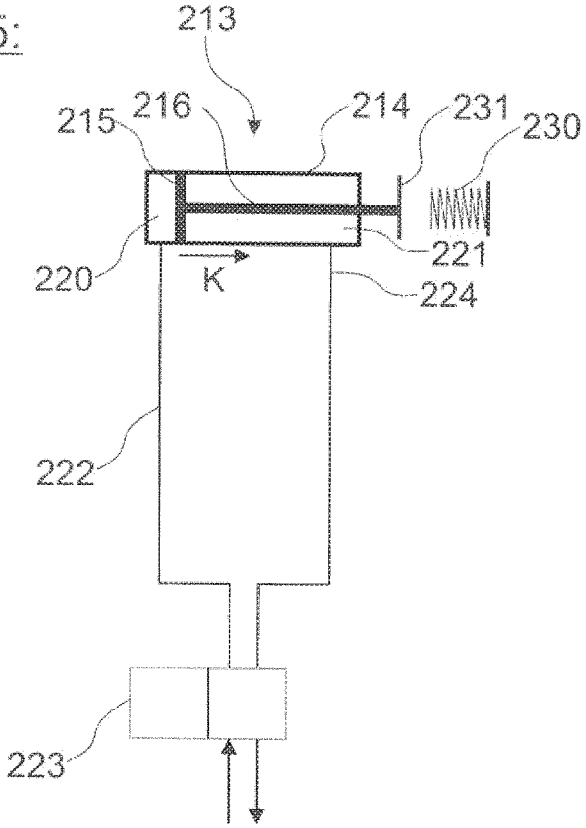

FIG. 5 a second structure of a filling device according to the invention

Figure 6:
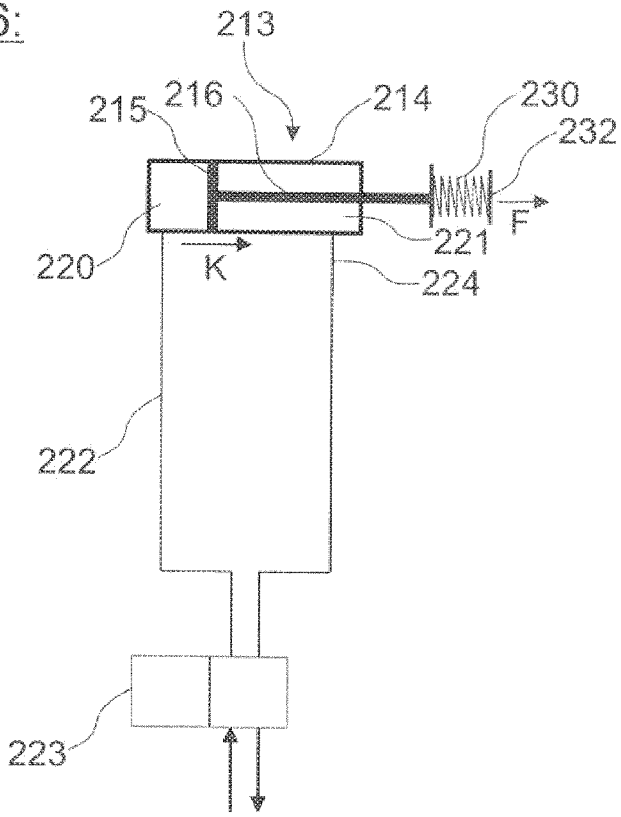

FIG. 6 like FIG. 5, but with a further moved piston

FIG. 1 shows a form-fill-seal machine 1, which is often referred to briefly as FS machine, which is appropriate for molding, filling and closing of bags and to which the teachings of the present document may be advantageously applied. This device 1 comprises a support arm 2 on which a wrap 3 with a tubular film 4 rests. The tubular film 4 includes lateral folds which are not depicted in FIG. 1. The transport rollers 5, which in part may also be driven, induce a normally continuous unrolling of the tubular film 4. The lever 9 on which a load is applied by means of a piston-cylinder unit 10, which supports a deflecting roller 6 and in total is often referred to as dancing device, and the transport rollers 7, 8 as well as the feed roller pair 15 ensure collectively in a manner known per se that the tubular film 4 is moved further intermittently on its further transport path. The transport roller 8*a* is part of a register device 29 by means of which the length of the transport path of the tubular film 4 may be adapted to the format of the subsequent bags 27. For this purpose, the transport roller 8*a* is arranged displaceably with respect to the device 1. A spindle drive which is manually driven or driven by an electric motor and which is known per se is available for the displacement.

The tubular film 4 is pushed through the welding jaws 33 of a cross-welding station 13 and through a cross-cutting station 16 by means of the feed roller pair 15. The tools of the cross-welding station 13 and of the cross-cutting station 16 may be moved in a manner which is not described in more detail, for example, by means of a parallelogram arrangement 14, in planes perpendicular to the feeding direction of the tubular film 4 towards the same and away from the same. Once the grippers 17 have gripped the tubular film 4, a tube piece 18 is separated from the tubular film 4 in the cross-cutting station 16 above the grippers 17. Concurrently, a cross weld is applied above the cutting edge at the tubular film 4 in the cross-welding station 13 which constitutes the base or the head side of the tube piece 18 to be formed in the next working cycle of the device 1. Accordingly, head seams are produced in the cross-welding station 13. However, generally, the production of the head or base seams may be performed not only by means of a cross-welding, although preferably by means of this, but also further joining methods, such as bonding, are conceivable.

The grippers 17 carry the tube piece 18 to a handover point at which additional grippers 19 grip the tube piece 18 and convey it to a filling station 20. There, the tube piece 18 is handed over to stationary grippers 21 and is opened by the suckers 22 such that the product, which is conducted through the filling device 23, may enter the tube piece 18. Thereby, the tube piece 18 rests with its lower end on a conveyer belt 24 such that the tube piece 18 is not excessively charged along its longitudinal edges during the filling operation. Additional grippers 25 convey the filled tube piece to the head or base seam welding station 26 in which the tube piece 18 is closed with a head or base welding seam and thus constitutes a finished bag 27. Likewise, the closing of the tube piece 18 in its head region may be performed by means of another joining method. The finished bag 27 is guided by the conveyor belt 24 out of the device 1. Hereby, the bag 27 is normally much higher (in the y direction) than it is wide (in the x direction).

FIG. 2 depicts now in more detail essential components of the filling device 23. The filling material 201 is provided in the dosing container 202. This means that the dosing container constitutes a reservoir for the filling material 201. Now it is necessary to separate a provided portion from this filling material for a bag. For this purpose, the discharge opening 203 of the dosing container is closed with a flap 204 which is moveable such as to release in part or completely the discharge opening. For this purpose, the flap 204 may be pivotally mounted about a pivoting axis 205, as shown in FIG. 2. With the open flap 204, the filling material 201 enters now the container 210. The latter may be provided with a scale which may measure the weight of the filling material inside the weighing container. This embodiment is shown in FIG. 2. The scale is represented by means of the two springs 211. These springs may be part of a spring scale. Of course, various other configurations of a scale and also various weighing methods are known to a person skilled in the art. Accordingly, the representation of a scale, and particularly of a spring scale, is not to be understood as a limitation.

If the desired weight of the portion of the filling material for a bag is reached now, then the flap 204 is closed again. Thereafter, the opening flaps 212 of the weighing container in the arrow direction P are opened such that the weighed portion of the filling material may be dispensed into the bag 27 by means of an optional filling hopper 115. However, FIG. 2 shows the opening flaps still in their closed position.

The opening and the closing of the opening flaps are performed by means of at least one driving element which in the present example embodiment is embodied as a piston-cylinder unit 213 which acts in two directions. Its cylinder 214 is pivotally connected to one of the two opening flaps, whereas the piston rod 216, which is connected to the piston 215 which is displaceable within the cylinder 214, is pivotally connected to the other opening flap. It should be noted that such piston-cylinder units may also be pivotally connected in another way. Thus, a piston-cylinder unit may be pivotally connected to an opening flap and the machine frame. Other driving types are also conceivable at this point.

In FIG. 3, essentially the same components as in FIG. 2 are depicted, although the opening flaps are now in their open position. At the same time, optional end stops 217 can be seen at which the opening flaps 212 may rest in their open position.

In FIG. 4, the piston-cylinder unit 213 with a driving element which is filled with fluid can be seen which is part of an advantageous embodiment of the invention. The piston 214 comprises a first volume 220 and a second volume 221 which are separated from each other by the piston 215. The volume 220 is connected to a fluid line 222 such that a fluid subjected to the excess pressure Pi may be introduced in the volume by means of a corresponding position of the directional valve 223 in which the fluid line 222 begins. For this reason, the piston 215 is displaced in the direction K, the fluid in the volume 221 being ejected and entering the fluid line 224 which at a branching point splits into a first fluid line branch 225 and into a second fluid line branch 226. The fluid line branch 226 ends in a switching valve 227 which has two switching positions. In a first switching position, the fluid stream is blocked such that the fluid cannot stream out of the fluid line. In a second switching position, the fluid may exit freely, i. e., without any resistance, from the fluid line 226. If the switching valve 227 is in the first switching position (fluid stream is blocked or interrupted), the fluid flows through the fluid line branch 225 in which a throttle 228 is arranged which constitutes a resistance. Preferably, the throttle 228 or its resistance is adjustable. From the throttle 228, the fluid enters into the directional valve 223 which is switched such that the fluid may be deflected, for example, to the environment, or into a fluid reservoir. The switching of the switching valve 227 to the first switching position and the conducting of the fluid through the throttle 228 which is caused this way induces a counterforce for the piston 215 which is slowed down this way. A switching of the switching valve 227 from the second switching position to the first switching position which is performed during the movement of the piston allows to perform the first part of the movement of the piston, which lasts until said switching of the switching valve, with a speed $v_1$ and to perform the second part of the movement, which starts as from the switching of the switching valve, with a speed $v_2$ which may be constantly reduced until the piston has reached its end position. Preferably, the speed $v_1$ is essentially constant or constantly increasing. Moreover, it is provided that $v_1$ is higher than $v_2$.

The timing of the switching of the switching valve 227 may be time-controlled and/or path-controlled. In the first case, the switching valve may be switched after a time period in which the piston is moving. For this purpose, a control unit, which is not depicted, is available which preferably triggers first the start of the movement of the piston and subsequently, once said time period has expired, the switching of the switching valve 227 from the second switching position to the first switching position. In the second case, a sensor 229 is provided which is arranged for sensing at least the exceeding of a point by the piston. The control unit may control the switching of the switching valve 227 immediately after a corresponding signal of the sensor 229.

In the example embodiment of FIG. 4, the configuration of a driving element which is filled with a fluid has been depicted only for the case of the opening of the opening flaps. Of course, such a configuration may also be provided additionally or alternatively for closing the opening flaps. For this purpose, first, the directional valve 223 may be switched such that the fluid subjected to excess pressure may be conducted into the volume 221. Moreover, the fluid line 222 would be provided with a branching point, a first branch conducting through a throttle to the directional valve 223 and a second branch conducting to a switching valve which is designed analogous to the switching valve 227 and also has a corresponding effect. For a combined operation it is advantageous when the throttles only offer resistance to the fluid in one direction. In the opposite direction there is no or only a low throttling effect. Likewise, a time and/or path control may be realized in a manner which has been discussed above in relation to the configuration shown in FIG. 4.

Preferably, a gas, particularly air, is provided as a fluid.

FIG. 5 shows another example embodiment of the invention. Here, the displacement of the piston is performed as in the example embodiment of FIG. 4 by means of the introduction of a fluid under overpressure into the volume 220 or 221. The delay, i. e., the slowing down of the movement of the piston may also be performed by means of a mechanical device, for example, a spring element, which acts directly or indirectly on the piston rod and/or on the opening flap, whereas the effect of the mechanical device occurs only in the second part of the movement. The effect of this mechanical element is discussed now by means of the spiral spring shown in FIG. 5 as an example. First, the element which is also moved by the moving piston (in this case the piston rod 216) is not in contact with the spiral spring. In the second part of the movement, the piston rod with its end region (in this case represented by way of example as the plate 231) comes into contact with the spring 230, which is depicted in FIG. 6. The force which is necessary for compressing the spring slows down the movement of the piston 215. The spring 230 itself may be fastened to a fastening element 232 which may be stationary with respect to the frame of the filling device.

However, it is advantageous when the fastening element may be moved away from the cylinder in the direction of the arrow F so as to reduce the spring force, the distance between the cylinder and the fastening element 232 being increased. Thereby, the movement profile of the fastening element 232 has to be adapted to the movement pattern of the piston 215 such that the desired delay is produced.

The mechanical device may also be embodied in other ways. Likewise, an electrical device or an electromagnetic device may be provided which acts on the piston and/or the piston rod so as to slow down the piston in the second part of the movement of the piston. Here, an eddy current brake as well as a switchable electromagnet are also conceivable.

Reference sign list

| | |
|---|---|
| 1 | Device for producing and filling bags |
| 2 | Support arm |
| 3 | Wrap |
| 4 | Film/tubular film/plastic tube |
| 5 | Transport roller |
| 6 | Deflecting roller |
| 7 | Transport roller |
| 8, 8a | Transport roller |
| 9 | Lever |
| 10 | Piston-cylinder unit |
| 11 | |
| 12 | |
| 13 | Cross-welding station |
| 14 | Parallelogram arrangement |
| 15 | Feed roller pair |
| 16 | Cross-cutting and cross-welding station |
| 17 | Grippers |
| 18 | Flexible tube piece |
| 19 | Grippers |
| 20 | Filling station |
| 21 | Stationary gripper |
| 22 | Suckers |
| 23 | Filling device |
| 24 | Conveyor belt |

-continued

Reference sign list

| | |
|---|---|
| 25 | Grippers |
| 26 | Head or base seam welding station |
| 27 | Bag |
| 28 | |
| 29 | Register device |
| 30 | |
| 31 | |
| 32 | |
| 33 | Support surface |
| 34 | Dashed line "height (y) of bag opening" |
| 35 | Arrow distance of opening 62 of the tube piece 18 to the support surface 58 in the vertical direction |
| 36 | Symmetry line of the filling nozzle 23 |
| 37 | Vibrator |
| 115 | Filling hopper |
| 201 | Filling material |
| 202 | Dosing container |
| 203 | Discharge opening |
| 204 | Flap |
| 205 | Pivoting axis |
| 206 | |
| 207 | |
| 208 | |
| 209 | |
| 210 | Weighing container |
| 211 | Springs |
| 212 | Opening flap |
| 213 | Piston-cylinder unit |
| 214 | Cylinder |
| 215 | Piston |
| 216 | Piston rod |
| 220 | First volume |
| 221 | Second volume |
| 222 | (First) Fluid line |
| 223 | Directional valve |
| 224 | (Second) Fluid line |
| 225 | Fluid line branch |
| 226 | Fluid line branch |
| 227 | Switching valve |
| 228 | Throttle |
| 229 | Sensor |
| 230 | Spring |
| 231 | Plate |
| 232 | Fastening element |
| F | Arrow, direction of movement of the fastening element |
| K | Arrow, direction of movement of the piston |
| P | Arrow, opening direction of the opening flaps |
| x | Transport direction of the bags |
| y | Direction orthogonal to the directions x and z |
| z | Direction of gravity |

The invention claimed is:

1. A filling device with a discharge container for filling upwardly open packaging containers, the discharge container comprising:

at least one opening flap being moveable along a path between a closed position and an open position by means of a driving element, at least one delay device comprising a throttle element, electrical brake, or spring by means of which the movement of the at least one opening flap may be delayed on a section of the path, and a switching element connected to the at least one delay device, wherein the switching element is configured to initiate the delay of the movement of the at least one opening flap produced by the at least one delay device as the driving element moves the at least one opening flap along the path.

2. The filling device according to claim 1, characterized in that the switching element comprises a lockable valve.

3. The filling device according to claim 1,
characterized in that
the delay device comprises a throttle element.

4. The filling device according to claim 3, wherein the throttle element is an air throttle.

5. The filling device according to claim 1,
further comprising a product scale adjacent to the opening flap.

6. A method for filling upwardly open packaging containers by means of a filling device with a discharge container, the discharge container comprising:
at least one opening flap being moved along a path between a closed position and an open position by means of a driving element,
characterized in that
the movement of the opening flap is delayed on a section of the path by means of at least one delay device comprising a throttle element, electrical brake, or spring, wherein the at least one delay device is connected to a switching element, wherein the switching element is configured to initiate the delay of the movement of the at least one opening flap produced by the at least one delay device as the driving element moves the at least one opening flap along the path.

7. A form-fill-seal-device comprising
a bag forming device by means of which tube pieces may be separated subsequently from a tube material whose lower ends may be provided in each case with a base such as to build upwardly open bags,
a filling device by means of which the upper openings of the bags may be closed, wherein the filling device comprises a discharge container comprising:
at least one opening flap being moveable along a path between a closed position and an open position by means of a driving element,
at least one delay device comprising a throttle element, electrical brake, or spring by means of which the movement of the at least one opening flap may be delayed on a section of the path, and
a switching element connected to the at least one delay device, wherein the switching element is configured to initiate the delay of the movement of the at least one opening flap produced by the at least one delay device as the driving element moves the at least one opening flap along the path,
retaining devices by means of which the bags may be retained within at least one of the devices mentioned above, and
transport devices by means of which the bags may be carried individually between the individual devices mentioned above.

* * * * *